US005169364A

United States Patent [19]

Donaldson

[11] Patent Number: 5,169,364

[45] Date of Patent: Dec. 8, 1992

[54] WEIGHT ATTACHABLE LEG EXERCISE DEVICE

[76] Inventor: Keith D. Donaldson, 107 Oak Rim Ct., #23, Los Gatos, Calif. 95032

[21] Appl. No.: 712,925

[22] Filed: Jun. 6, 1991

[51] Int. Cl.[5] ..... A63B 21/065

[52] U.S. Cl. ..... 482/105; 482/93; 482/139; 482/148

[58] Field of Search ..... 272/96, 117, 119, 122, 272/123, 143, 145; 128/71, 75; 36/80, 117; 482/79, 80, 93, 105, 106, 108, 109, 139, 144, 145, 148

[56] References Cited

U.S. PATENT DOCUMENTS

| | | | |
|---|---|---|---|
| D. 267,343 | 12/1982 | Miller et al. . | |
| 2,114,790 | 4/1938 | Venables | 272/119 |
| 2,952,459 | 9/1960 | Moffitt . | |
| 3,380,447 | 4/1968 | Martin | 272/145 X |
| 4,121,359 | 10/1978 | Berteto et al. | 36/117 |
| 4,150,500 | 4/1979 | Delert | 36/117 |
| 4,497,314 | 2/1985 | Miller . | |
| 4,515,152 | 5/1985 | Teeter . | |
| 4,523,582 | 6/1985 | Barber | 272/145 X |
| 4,565,370 | 1/1986 | Christanson | 272/145 |
| 4,684,122 | 8/1987 | Desmond et al. | 272/119 |
| 4,838,546 | 6/1989 | Winston . | |
| 4,896,879 | 1/1990 | Klawitter . | |
| 4,911,434 | 3/1990 | Herring . | |
| 4,988,097 | 1/1991 | Smith et al. | 272/119 |
| 5,009,416 | 4/1991 | Carothers | 482/106 X |

FOREIGN PATENT DOCUMENTS 3514513 10/1986 Fed. Rep. of Germany ..... 272/119

*Primary Examiner*—Robert Bahr

*Attorney, Agent, or Firm*—Jacques M. Dulin; Thomas C. Feix; Rosenblum, Parish & Isaacs

[57] ABSTRACT

A leg exercise device for permitting isolated exercises of selected muscle groups of the lower extremity comprising a generally tubular ankle collar or boot having an inner surface conformingly fitted to a user's ankle region. The outer forward facing surface of the ankle boot includes an upturned J-shaped hook member adapted to receive a weight clip member. The weight clip member includes means for retainingly engaging a rod or bar portion of a conventional weight, such as a dumbbell, and is lockable to the hook member of the boot. The boot includes front and back half portions which are hinged together along a first common side and which have an adjustable buckle member for closing the two halves together along their second common side. The front half portion of the boot includes a anti-torsion strap member which is looped under the ball of the user's foot to prevent up and down and side-to-side or torsional movement during use. The interior surface of the ankle boot is sufficiently padded to provide a snug and comfortable fit of the ankle boot about the user's foot.

15 Claims, 3 Drawing Sheets

WEIGHT ATTACHABLE LEG EXERCISE DEVICE

FIELD

The present invention relates generally to an improved leg exercise device to assist the user in isolating certain muscles of the lower extremity for weight training exercise and rehabilitation. More particularly, the invention relates to an improved ankle collar (herein a "boot") and weight clip assembly whereby the weight clip is used to pick up and retain a universally available weight, such as a dumbbell, and is insertably mountable into an upturned hook member provided to the outer surface of the ankle boot. The weight clip also includes means for locking engagement with the hook member.

BACKGROUND

Body builders and other weight training enthusiasts often find it difficult to perform weight training exercises which isolate certain muscles of the lower extremity. A preferred way for achieving muscle balance in the lower extremity and/or strengthen certain leg muscles which may have atrophied after an accident or injury is by working isolated muscles or muscle groups through a series of controlled leg exercises. A problem arises when a person only has access to conventional weight training equipment which is found in gyms, spas or the home, since it is often inconvenient and sometimes even dangerous to modify conventional weight training equipment for specialized use in the isolated strengthening of the hamstrings, quadriceps, calves, etc.

There are disclosed in the prior art various forms of leg exercise devices which are directed to attaching weights to an ankle boot worn by the user. The goal of these devices is to increase muscular effort by adding weight so that muscular development in certain muscles is enhanced. These prior art leg attachment devices suffer from many defects in that they are: uncomfortable to wear; difficult to use; require the use of specialized, non-standard weights; or suffer from a combination of all the above defects.

U.S. Pat No. 2,952,459 (Moffit) discloses a leg exercise devise comprising a brace which is circumferentially strapped to the leg just below the knee and includes a pair of elongated bars, which during use, are vertically disposed to lay against the inside and outside of the leg. Specially shaped weights are attached to the bars by means of a groove provided to each weight, which groove is adapted to slidingly engage the edge portions of each elongated bar. U.S. Pat. No. 4,838,546 (Winston) teaches to provide a wrap-around fabric ankle strap having a plurality of elongated pockets, each of which are adapted to receive one or more specially shaped cylindrical weights. Both Moffit and Winston require special, limited use weights which are used only in combination with their respective leg exercise devices. Further, neither Moffit n or Winston suggest or teach to provide any means for preventing their leg exercise devices from moving up or down the user's shin or twisting about the user's leg or ankle which tends to occur during a swinging leg movement.

U.S. Pat. No. 4,911,434 (Herring) discloses a weight apparatus for exercising which comprises a pair of ankle cuffs which are interconnected by a weight supporting strap. In use, the strap is disconnectable from either ankle cuff and is disposed to support conventional disc-shaped weights. This is accomplished by threading a disconnected strap end through the conventional weights bar-receiving hole provided in the center portion of each disc-shaped weight, and then reconnecting that strap end to its respective (other) weight cuff. This apparatus is directed to adding a single, dead weight load to both legs simultaneously to perform various weight training exercises involving both the upper and lower body. It is not well suited for the exercises of a single leg in view of the dual ankle cuff and interconnecting strap arrangement. Indeed, it would be extremely difficult to perform isolated muscle exercises of one leg independent of the other leg, even if one ankle cuff was disconnected from the strap. Also, since the attached weights are permitted some degree of swingable movement, there exists the potential for user injury, for example, a moving weight hitting the user's leg.

Another leg exercise device which permits adjustment of the weight load resistance over a continuous range is disclosed in U.S. Pat. No. 4,896,879 (Klawiter) wherein an L-shaped, liquid (or sand) fillable container is strapped to the user's foot. To vary the resistance load of this leg exercise device, the user must first remove the device from his or her foot in order to add fluid to, or remove fluid from, the container. The user is also exposed to the risk of fluid spillage when attempting to vary the fluid volume of the container. Over time, repeated fluid spillage will tend to damage the padding and straps associated with the device. A further disadvantage with this device is that when the fillable volume is only partially filled, the weight tends to shift when the device is lifted. Also, the maximum weight load is limited by the total volume of the container.

It is also known from the prior art to provide a padded ankle boot having a hook disposed on a forward facing surface or shin covering which is adapted for receiving a fixed horizontal bar. These boots are well known in the art as "inversion boots", and are intended for use in suspending a human in an inverted posture from a fixed support, such as a horizontal bar. Examples of inversion boots include U.S. Pat. No. 4,497,314 (Miller); U.S. Pat No. 4,523,582 (Barber); U.S. Pat No. 4,515,512 (Teeter); and Des. 267,343 (Miller et al). None of these patent documents teach to adapt the hook portion of the inversion boot to accept the attachment of conventional weights in order to perform isolation exercises for the lower extremity while the user is in an upright position.

There is a definite need in the art for a leg exercise and rehabilitation device which includes means for the attachment of conventional, readily available weights to a boot member worn by the user. There is also a need in the art for such an exercise device wherein the boot is securely and adjustably mountable on the user's ankle region and includes an additional strap for preventing torsional movement of the boot (and the attached weight) about the user's ankle region. Further, there is a need for such a leg exercise device which is easy to use, comfortable to wear and is inexpensive to manufacture.

THE INVENTION

Objects

It is a primary object of the invention to provide a leg exercise and rehabilitation device whereby conventional, readily available weights are conveniently and removably attachable to an ankle boot worn by the user thereof;

It is another object of the invention to provide a leg exercise device whereby a hand graspable weight clip is used to pick up and retain the weights in a balanced manner and whereby the weight clip is also mountable to a receiving member on the outer surface of the ankle boot;

It is another object of the invention to provide the ankle boot having means for size adjustment so that it is comfortable to wear and is stably secured to the user's ankle during use;

It is another object of the invention to provide a leg exercise device which is inexpensive to manufacture;

It is another object of the invention to provide a leg exercise device whereby a pair of ankle boots and a pair of weight clips are interconnectable to form a single unit for transportability or for packaging in kit form;

Still other objects will be evident from the drawings, specification and claims that follow.

DRAWINGS

SUMMARY

Figure 1:
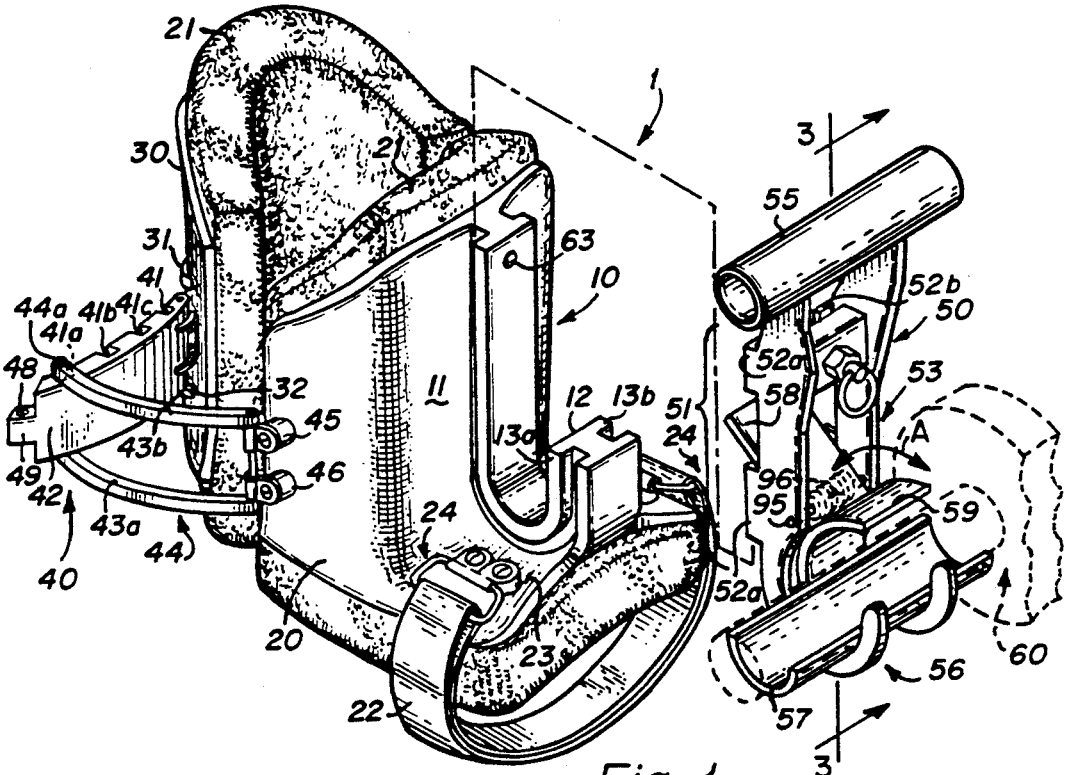
FIG. 1 is an exploded isometric view of a leg exercise device of this invention showing an ankle boot and adjustment buckle in the open position.

The invention comprises a weight attachable leg exercise and rehabilitation device for permitting isolated exercises of leg muscles or leg muscle groups, such as hamstrings, quadriceps, calves and the like, comprising a generally tubular ankle conforming boot which is adapted to receive attachment of a hand-holdable weight clip assembly. The weight clip assembly is used for holding conventional weights, such as dumbbells, barbells and the like, and is interengageable with another like clip so that the pair can be stored or transported easily.

The ankle boot further comprises a front and back half portion, both of which are connected along a common inward side by a hinge member and when closed are held together by an adjustable buckle assembly disposed along the opposite outward common side of the boot halves. The front half of the boot includes an upturned J-shaped member formed into a forward surface corresponding to the shin area of the user and is adapted to receive a corresponding engaging surface of the weight clip. The inside surface of both halves is provided with a suitably thick layer of padding, preferably a 1" thick formed neoprene padding, to provide a snug and comfortable fit for the user during use.

The buckle assembly is specially designed to resist torsional flex induced by changes in momentum and weight loads placed on the boot as the user moves the weight attachable boot through a range of exercise motions. Positive closure of the buckle assembly is made possible by a wide buckle tab and buckle loop engagement means and a pair of upraised rib supports formed into the back half surface of the boot which are disposed to support the side arms of the buckle loop as the buckle assembly is closed tight. This feature substantially inhibits side-to-side and torsional play in the buckle assembly.

The front half of the boot includes a flange portion extending outwardly from the lower end which covers the top surface of the user's foot when the boot is worn. An anti-torsion strap is also provided which is looped around the bottom of the user's foot and is connected at each of its ends to corresponding outside edges of the flange. The strap is preferably constructed of VELCRO TM material and is doubled back through a ring member at each end, to permit adjustability and to insure that the boot remains securely fastened to the user's foot to limit up-and-down, and side-to-side, and torsional movement of the boot about the user's ankle during use.

The weight clip is generally defined as an elongated body having a hand-graspable handle at its top end and a weight-receiving hook at its bottom end. The weight-receiving hook includes a spring biased weight release member, having a bar engaging surface which is disposed to enclose a top portion of a weight bar or rod, (for example, the rod portion of a dumbbell) and combines with the weight-receiving hook to provide a substantially circumferential enclosure for the rod portion of the dumbbell. The weight of the dumbbell provides the necessary retaining force for the spring-biased weight release member to securely hold the dumbbell within the weight receiving hook of the weight clip. In use, the user grabs the weight clip by the handle and "scoops up" the dumbbell weight by engaging the bar portion of the barbell with the weight receiving hook as previously described. The weight clip and attached dumbbell are then ready for mounting onto the J-shaped hook member of the boot.

The engaging surface of the weight clip includes a plurality of tang members which cooperate with the side edges of the J-shaped hook member to provide a snug fit between the weight clip and hook member. Locking means are also provided in the weight clip which lock it to the J-shaped hook member. In one embodiment, the locking means is a spring-biased retaining pin actuated by a pull ring. The retaining pin is receivingly engaged within a corresponding axially aligned hole provided in the hook member as the weight clip is being mounted on the hook.

An alternate embodiment for the fastening means for the anti-torsion strap includes a buckle enclosure similar to the buckle enclosure provided for securing the front end rear boot halves together. The buckle is held closed by the overlapping bar rest member when the weight clip is inserted within the hook member.

The invention also provides for a packaging embodiment whereby left and right side ankle boots and their respective weight clips are fully interconnectable and stowed within a carrying case.

The preferred materials of construction for the boot halves, hook member, and weight clip include any number of suitable hard plastic materials, which may be easily formed by known injection molding techniques for thermoplastics.

The invention may be used for isolated leg muscle exercise or rehabilitation of hamstrings, quadriceps, calves, etc. The invention permits the user to exercise one leg independent of the other, and is particularly suited for correcting muscle imbalances for predominantly right- or left-legged athletes, or for rehabilitation of post-operative or post-injury patients whereby certain leg muscles may have atrophied with respect to other leg muscles. The invention also permits a wide variety of leg exercises whereby the user may use conventional weights found in spas, gyms or in the home.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what I presently believe is the best mode of carrying out the invention.

Figure 2:
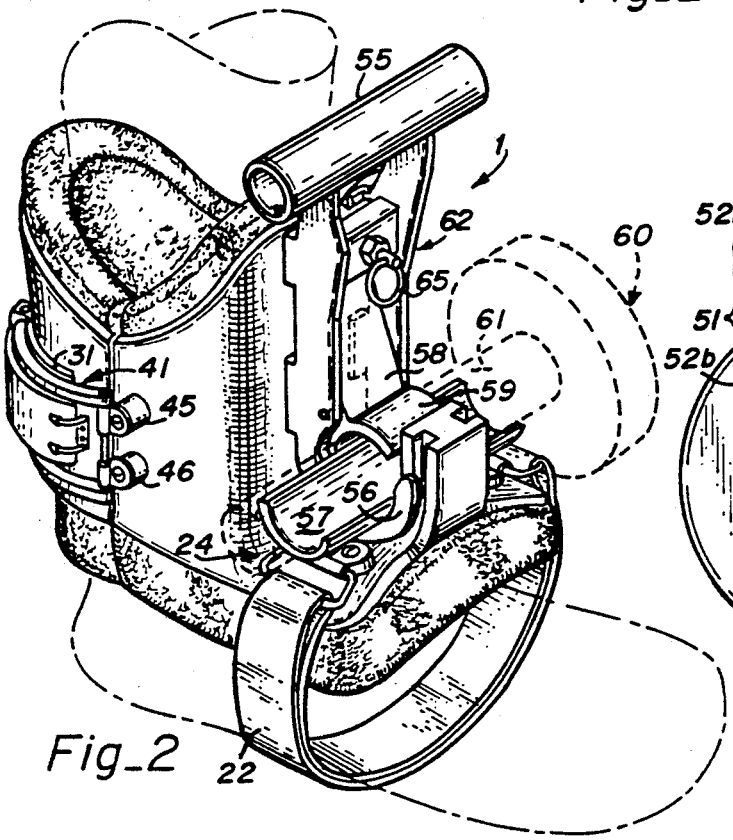
FIG. 2 is an isometric view of the leg exercise device of FIG. 1 showing a use position.
Figure 4:
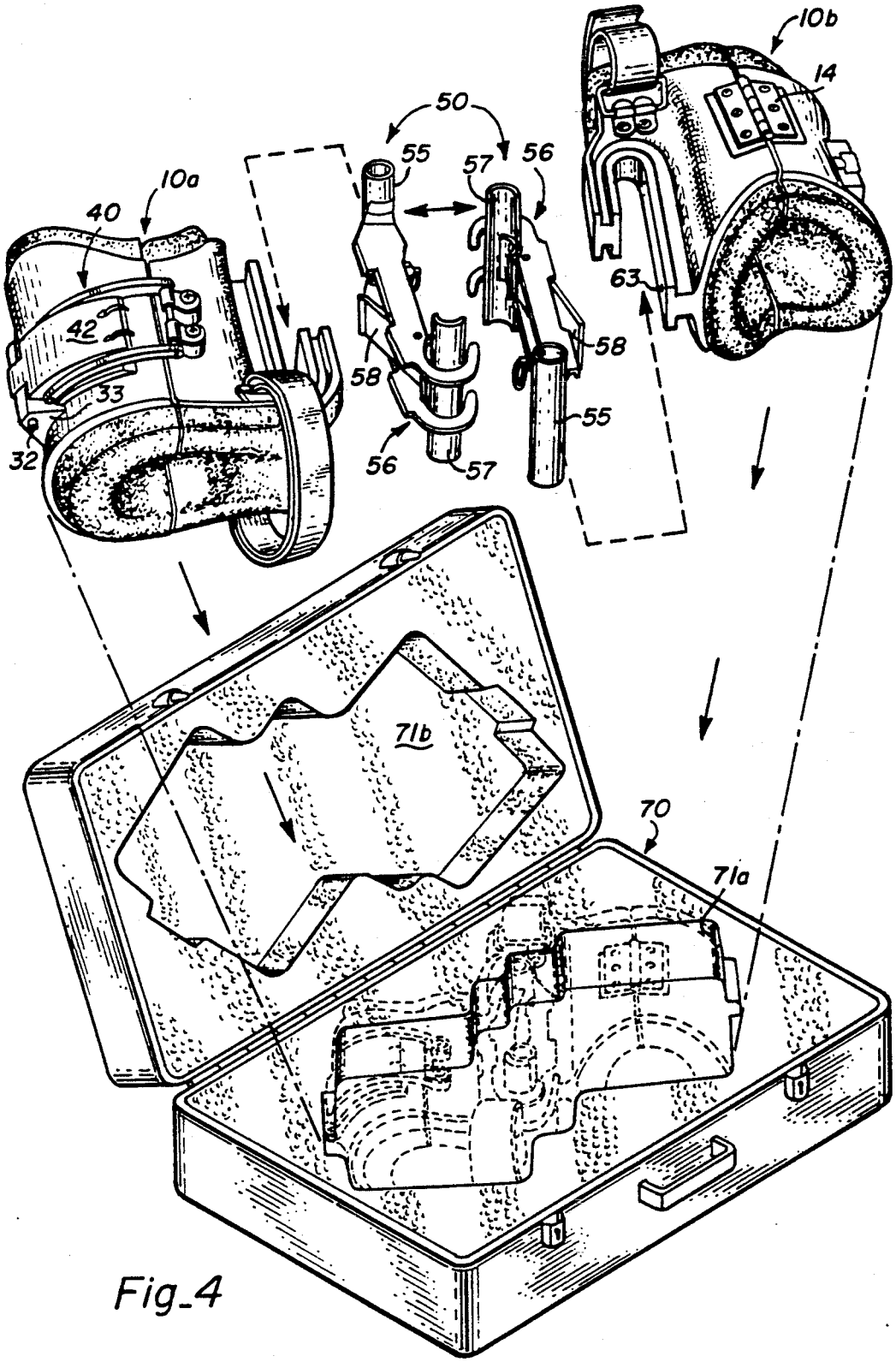
FIG. 4 is an exploded isometric view of the weight clip of a matching pair of leg exercise devices showing a packaging embodiment.

A leg exercise device constructed in accordance with one embodiment of the present invention is indicated generally by the reference numeral 1 in FIG. 1. FIG. 1 shows the device in an exploded isometric view to illustrate the principle parts of the invention as well as indicating (by arrows) the direction of motion of the adjustment features of the principle parts. The leg exercise device 1 as shown in FIGS. 1 and 2 is intended for use with a user's right leg such that the buckle assembly 40 is disposed adjacent the outside portion of a user's lower leg when the boot is worn by the user and clamped shut. A corresponding leg exercise device for the left leg is merely a mirror image of the right legged device. FIG. 4 shows a complete pair of leg exercise devices.

The leg exercise device 1 comprises a boot 10 and a weight clip 50. The boot 10 further comprises a front half or shin portion 20 which is connected by means of a hinge 14 (see FIG. 4) to a back half or achilles portion 30. A generous layer of padding 21, preferably constructed of neoprene foam padding approximately 1 in. thick, is provided to the inside surfaces of both the front and back halves 20 and 30 of the ankle boot 10. An adjustable buckle assembly 40 secures both front and back halves 20 and 30 together.

The front half 20 of boot 10 has disposed on its forward facing upstanding surface 11, a generally J-shaped hook member 12, which is adapted to receivingly engage a corresponding hook contact area 51 of the weight clip 50. This is best seen from reference to the sequence shown in FIGS. 1 and 2. In the preferred best mode of the invention, the hook member 12 is T-shaped in cross section, and is further defined by the laterally extending edges or lips 13*a*, 13*b*. The hook contact area 51 of the weight clip 50 includes tangs or flanges 52*a*, 52*b* (see FIG. 6) which engage the corresponding edges 13*a*, 13*b* of the hook member 12 to provide a tight tolerance fit of the weight clip 50 to the hook member 12.

The front boot half 20 is also provided with an adjustable anti-torsion strap 22 which, in use, is directed under the arch or ball of a user's foot to secure the boot 10 to the foot. This is best seen in FIG. 2. The strap member 22 also serves to prevent any side-to-side play or torsional rotation of the boot 10 about the user's ankle which may occur during momentum changes associated with the combined load of the weight and weight clip when the user moves the ankle boot through a range of exercise motions. In one embodiment, the strap 22 may be connected to opposite sides of the lower boot surface 23 by a pair of loop-type rings 24. To permit adjustment of the strap's length, corresponding sides of the strap 22 may be releasably attachable to each other by using VELCRO TM fastening material in accordance with known fastening techniques.

It is an important feature that any number of leg exercises may be performed by use of this invention, including but not limited to leg curls, leg extensions, lateral leg lifts, etc. Also, the boot and attachable weight clip permit the specific isolated leg exercise to one leg individually at any location using commonly available weights. Thus, the user no longer has to wait in line, for example, to use the gym's leg machine. The user simply grabs a dumbbell off the weight rack with the weight clip, clips the weight clip onto the hook member of the boot and begins exercising at his own pace.

FIGS. 1, 2 and 4 show the detail of the buckle assembly 40. The buckle assembly 40 comprises a buckle loop 44 and a buckle tab 42. The buckle loop 44 is rotatably mounted to the front half 20 of boot 10 at mounts 45 and 46. In the preferred embodiment, the outer surface of the boot 10 is tapered, being wider at its bottom portion than at its top portion. This difference in width is evident from FIGS. 1 and 2, and in view of the inclusion of the transversely flared and forwardly extending flange portion associated with front boot half 20. This aforementioned flange portion extends over the top surface of a user's foot. Accordingly, the height or outwardly lateral extension of mounts 45 and 46 for buckle loop 44 are of different lengths in order to keep the axis of pivotal rotation of buckle loop 44 parallel to the axis of hinge 14 (see FIG. 4).

Size adjustment for the calf and ankle width opening of the boot 10 is accomplished by selectively inserting the loop end 44*a* of buckle loop 44 in one of a plurality of spaced grooves 47*a–d* provided in the underside surface of buckle tab 42. FIG. 2 shows loop end 41*a* engaged with groove 47*a* corresponding to the tightest setting of buckle assembly 40. As is best seen in FIGS. 1 and 4, the buckle 40 may be looked in the closed position by actuating a pin member 32 which is disposed to engage bore 48 of tongue 49 of buckle tab 42. The pin member 32 is housed within the buckle tab receiving structure 33 which is formed into the back half 30 of boot 10.

Since a principal concern of the invention is to provide a boot that is comfortable to wear and remains securely positioned about the user's ankle during use, it is important that the parts of the buckle assembly 40 (buckle loop 44 and buckle tab 42) remain in firm engagement while the buckle assembly 40 is in its closed position. This will insure against the two boot halves 20, 30 from separating, even slightly, so that the boot 10 will not twist or rock about the user's ankle during use. To this end, a pair of parallel upraised ridges 31 and 32 are formed into the side surface of the back boot half 30 to provide a bottom support surface for the corresponding arm members 43*a* and 43*b* of buckle loop 44 when the buckle loop 44 is moved to the closed position (see FIGS. 2 and 4). A tight tolerance fit between the top surface of upraised ridges 31, 32 and the underside of arm members 43*a*, 43*b* results in a very positive buckle closure and a significant reduction in "buckle slop" or up-and-down/side-to-side play between the loop arms 43*a*, 43*b* of buckle loop 44 and the outside surface of boot 10 is achieved. In addition, the distance width between arms 43*a*, 43*b* of buckle loop 44 and the corresponding width of buckle tab 42, grooves 47*a–d* and mounts 45 and 46 are sufficiently wide to resist torsion induced movement of the buckle assembly 40 during use.

Figure 3:
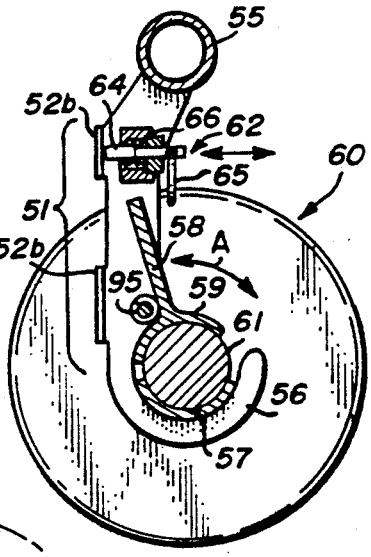
FIG. 3 is a side elevation view shown in partial cross section taken along the line and in the direction of arrows 3—3 of FIG. 1.

FIG. 3 shows the detail of the weight clip 50. The weight clip 50 comprises an elongated body 53 having a handle 55 disposed at its top end and a weight receiving hook 56 disposed at its bottom end. The weight receiving hook 56 has attached thereto a bar rest member 57 for supporting a bar portion of a conventional weight apparatus, such as a dumbbell set (a fragmentary depiction of a dumbbell set is shown in phantom). The bar rest 57 is conveniently an arcuate portion of a tube the I.D. of which is the O.D. of handle 55. For purposes of the remaining detailed description, the weight apparatus will be referred to henceforth as a "dumbbell" or "dumbbell set". It is understood that the dumbbell to be used may be of the plastic, sand-filled variety or any conventional universal weight bar which is adapted to carry matching weights on both of its ends. The weight clip 50 also includes a spring-biased weight release member 58 having a rod engaging surface 59 which, when pivoted moves on pin 95 in the direction of arrow A, is disposed to retain the upper surface of bar portion 61 of the dumbbell 60 in a manner substantially as shown in FIGS. 1-3. The spring 96 is conveniently located on pin 95.

In Operation, a user first opens the boot 10, places the front and back halves 20, 30 around his ankle with the front half 20 position over the user's shin. The user's toes are inserted through the loop created by slackened strap 22. The buckle assembly 40 is adjusted for the user's ankle diameter size and buckle closed with pin member 32 being depressed to lock the buckle tab 42 in place within the buckle tab receiving structure 33 of back boot half 30.

Next, the strap 22 is tightened to firmly secure the bottom of the boot 10 to the top of the user's foot. Holding the weight clip 50 by handle 55, the user then selects the desired dumbbell set by "scooping up" or engaging the center bar portion 61 of the dumbbell with the receiving hook 56 such that bar 61 is supported by bar rest member 57. This causes the spring-biased weight release member 58 to pivot close such that the engaging surface 59 forms an upper enclosure for holding the bar 61 secure against bar rest member 57 of receiving hook 56. The weight of the dumbbell set 60 provides the necessary holding force for the spring biased release member 58 and engaging surface 59 to securely retain the bar 61.

With the bar 61 firmly engaged by the receiving hook 56 of weight clip 50, the user then positions the weight clip 50 with contact area 51 facing hook member 12 and inserts the weight clip 50 into the hook member 12 such that tangs 52*a*, 52*b* of the elongated body 53 engage the corresponding edges 13*a*, 13*b*. Just prior to completely inserting contact surface 51 of the weight clip 50 within hook member 12, a spring loaded retaining pin assembly 62 is pulled back to permit clearance between the pin end 64 and the hook member 12 so that the weight clip 50 can be locked into place. The user releases the ring 65 of the retaining pin assembly 62 which permits spring 66 to urge pin end 64 to be receivingly engaged within axially aligned hole 63 of the hook 12. This corresponds to the locked position of the weight clip 50 within the hook 12 which is shown in FIG. 2.

FIG. 4 illustrates a packaging embodiment of the invention whereby a pair of boots 10*a* and 10*b*, corresponding to a right and left boot, respectively, are shown with their respective weight clips 50. The boots 10*a*, 10*b* and weight clips 50 may be interconnected to permit the user to carry, in tote fashion, the complete interconnected unit to and from the home, the spa, the gym, etc. Note that the weight clips 50 are universal, that is, there is no distinction between a left and right weight clip.

Interconnection of the boots and weight clips to each other may be done in any number of operative ways. For example, the two weight clips 50 can be oriented facing each other, one inverted with respect to the other and then snapped together so that the each handle of each weight clip is receivingly engaged by the weight receiving hook and spring biased weight release member of the other weight clip. This is followed by insertion of the connected weight clips into each hook member. The orientation of the component parts of the interconnected unit is best seen by reference to the arrows in FIG. 4. Once the boots and weight clips are completely interconnected, the entire unit may be stowed within a suitcase 70 (the interconnected unit is shown in phantom). In the preferred kit embodiment, the suitcase 70 is provided with a padded, conforming inner cavities 71*a*, 71*b* which serve to hold the combined boot and weight clip unit in secure fashion within suitcase 70. In the preferred embodiment, the padded inner surface 71 is constructed of urethane foam padding, but it is understood that other known padding materials may be used in combination with the suitcase 70, or any carrying case, duffle bag, etc.

In another example for connecting the ankle boots and weight clips together, each weight clip is first mounted to their respective boots, followed by the engagement of the receiving hook portion of a first weight clip to the handle of the second weight clip. This permits the free handle of the first weight clip to be grasped by the hand of the user in toting around the completed interconnected unit.

The preferred materials of construction used for the weight clips, front and back boot halves and hook member (excluding springs, pins and their related hardware) is of a sufficiently strong injection molded thermo-plastics. This results in an interconnected unit which is very light in overall weight and is easily hand-carried by a user with any modicum of strength.

Figure 6:
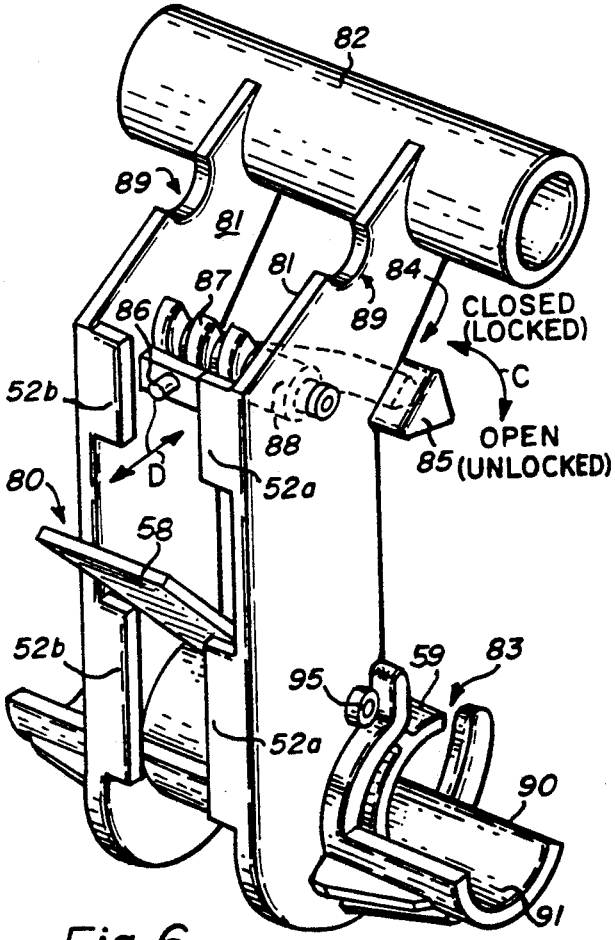
FIG. 6 is an isometric view of an alternate embodiment for the weight clip.

FIG. 6 shows an alternate embodiment for adjustably securing the anti-torsion strap 22 to a user's foot, wherein a hinged buckle 65 is substituted for one of the two rings 24 of FIGS. 1 and 2. The buckle 65 includes a snap-fit opening 66 which is adapted to receivingly engage buckle loop end 67 in the manner as shown in FIG. 6. The buckle 66 also includes a hinged end 68 (a portion of which is integrated into the lower boot surface 23) and is disposed to pivot from an open to closed position about axis A—A. In use, after the user has inserted his toes through the loop-type opening provided by a slackened strap 22, the hinged buckle 65 is pivoted to its closed position (shown in phantom) which, in turn, draws buckle loop end 67 towards hook member 12 and tightens the strap 22. Fine adjustments to the strap may be accomplished by preadjusting the velcro fasteners of the strap prior to moving the hinged buckle 65 to the closed position. Once the weight clip 50 is mounted onto the hook member 12, the bar rest member 57 overlaps the buckle 65 to keep it closed.

Figure 5:
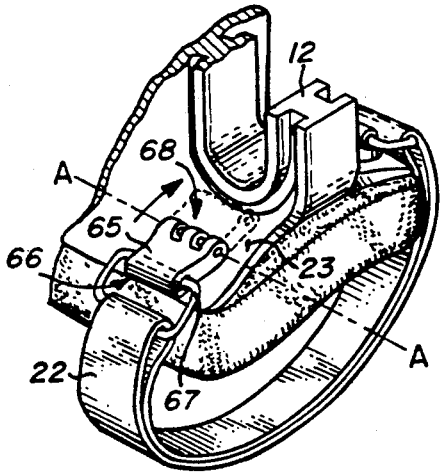
FIG. 5 is a fragmentary isometric view of an alternate embodiment of the adjustment means for the anti-torsion strap.

Another important feature of the invention is the comfortable fit of the boot 10 and the simplicity in making size adjustments to insure that the boot remains comfortable for different users and remains securely in place on each user's ankle during use. Size adjustment is made simple by use of the hinged buckle 65 for the anti-torsion strap 22 of FIG. 5 and buckle assembly 40 of FIGS. 1 and 2 as they permit quick, secure and rapid adjustment. Thus, the exercise boots of this invention are ideal for use in exercise gyms or spas where the ankle boots are used by a variety of different users having different size adjustment needs.

FIG. 6 shows an alternate embodiment for the weight clip 80 whereby the upper side members 81 of the elongated body are angled forward and upward to position the axial center of handle 82 slightly off-center with respect to the axial center of receiving hook 83. It is important to note that the design of weight clip 80 for this alternate embodiment still permits the snap-together interconnection of the weight clips in an upside down and opposed manner similar to the arrangement shown in FIG. 4. Also shown in this alternate embodiment for the weight clip 80 is an alternate weight clip retaining assembly 84 for securing the weight clip 80 within the hook member 12 of a boot 10. The retaining assembly 84 includes a spring biased lever 85 which is disposed to move in the direction shown by reference to arrow C in FIG. 6.

In use, the user depresses the lever 85 downward with a finger or thumb which, in turn, causes retaining pin 86 to linearly reciprocate inward (by cam action) in the direction shown by reference to arrow D. This inward reciprocation of retaining pin 86 permits the weight clip 80 to be completely mounted within the hook member 12 of a boot. To lock in the weight clip, the lever 85 is released which permits the engagement of retaining pin 86 within the axially aligned hole 63 of a hook member 12 as before. Preferably, a cam lobe 87 is provided to the pivot axle 88 and is disposed to engage an end of the retaining pin 86, such that, as the spring-biased lever is moved away from contact with the slanted leading edge of upper side member 81, the contacting edge of the cam lobe 87 against retaining pin 86 retracts. This permits a spring associated with retaining pin 86 (not shown) to urge the retaining pin 86 into its retracted position. To extend the retaining pin 86 (i.e., such as for locking purposes), finger or thumb pressure is released from spring-biased lever 85 which, in turn, causes it to return to its rest position (as shown in FIG. 6) and rotate cam lobe 87 causing the retaining pin 86 to extend outwardly. This action would correspond to locking the pin 86 in place within hole 63 of hook member 12.

The upper side members 81 also include matching relieved areas 89 along their upper edges. These relieved areas 89 permit the compact interconnection of weight clips 80 to each other as each separate weight clip 80 is snapped-together in inverted fashion. This permits the leading edge 90 of bar rest member 91 of each weight clip 80 to fully wrap around the handle 82 of the other weight clip 80 since it is received by the relieved areas 89 of upper side members 81. The depth of the relieved areas 89 is sufficient to permit each bar rest member to enclose the corresponding handle so that the two weight clips 80 are held together in a compact, snap-together fashion.

It should be understood that various modifications within the scope of this invention can be made by one of ordinary skill in the art without departing from the spirit thereof. I therefore wish my invention to be defined by the scope of the appended claims in view of the specification as broadly as the prior art will permit.

I claim:

1. A leg exercise device for exercising a human leg comprising in operative combination:

(a) an ankle boot of a generally tubular shape configured to conformingly fit over a user's ankle region, said ankle boot having a hook member disposed along a portion of an outer surface of said ankle boot, said ankle boot including a first, front half boot portion and a second, back half boot portion wherein:

(i) said front half boot portion is disposed to cover a user's shin and front ankle area when said ankle boot is worn by the user;

(ii) said back half boot portion is disposed to cover a user's achilles tendon and rear ankle area when said ankle boot is worn by the user;

(iii) a hinge member connecting said front and back half boot portions along an inwardly disposed longitudinal mating edge surface of each of said half boot portions to permit the hinged opening and closing of said ankle boot about the user's ankle;

(iv) an adjustable buckle assembly disposed adjacent an outside longitudinal mating edge surface of each of said half boot portions to securely fix said ankle boot to a user's ankle while permitting size adjustment of said ankle boot;

(v) means for locking a free tab end portion of said buckle assembly to said back half boot portion when said buckle assembly is adjusted to a closed position, said locking means preventing inadvertent opening of said buckle assembly during use;

(b) means for releasable locking engagement of a dumbbell-type weight to said ankle boot hook member; and (c) means for securing said ankle boot to said user's foot to reduce torsional movement of said ankle boot about the user's ankle during exercise when said dumbbell-type weight is lockingly engaged to said ankle boot hook member.

2. A leg exercise device as in claim 1 wherein said outer surface of said ankle boot is provided with at least one upraised ridge member disposed adjacent a buckle arm loop portion of said adjustable buckle assembly for bottom support of said buckle arm loop when said buckle assembly is snapped closed so that side-to-side play and torsional flex of said buckle assembly is reduced.

3. A leg exercise device as in claim 2 wherein said ankle boot hook member is disposed on a forward facing surface of said front half boot portion.

4. A leg exercise device as in claim 3 wherein an ankle conforming layer of padding is provided to an inside surface of each of said boot halves.

5. A leg exercise device as in claim 4 wherein:

(a) said means for mounting said dumbbell-type weight is a weight clip;

(b) said weight clip comprises a generally elongated member having a pair of spaced sides, a front and back facing portion, and a top and bottom end portion; and (c) said elongated weight member clip member includes:

(i) a handle disposed adjacent said top end portion;

(ii) a weight-receiving hook member disposed adjacent said bottom end portion with said hook member projecting outwardly and upwardly from said front facing portion of said elongated body; and (iii) a spring-biased weight release member disposed in association with said weight-receiving hook member, said weight release member assisting said weight-receiving hook member in retainingly engaging a center bar portion of a dumbbell-type weight when said center bar portion is received within said weight-receiving hook member.

6. A leg exercise device as in claim 5 wherein:

(a) said back-facing portion of said weight clip elongated member includes a plurality of projecting tang members for slidingly engaging corresponding edge portions of said ankle boot hook member.

7. A leg exercise device as in claim 6 wherein:

(a) said weight clip includes means for locking said weight clip to said hook member.

8. A leg exercise device as in claim 7 wherein:

(a) said locking means includes a pull ring member for actuating a spring-biased retaining pin, said pull ring member is disposed in association with said front-facing portion of said weight clip; and (b) said hook member has a bore hole for receivingly retaining said spring-biased retaining pin when said weight clip is mounted onto said hook member and said pull ring is actuated by said user.

9. A leg exercise device as in claim 8 wherein:

(a) said front half portion includes a laterally extending and transversely flared portion disposed to cover a top surface of a user's foot; and (b) said securing means is an adjustable strap having a pair of ends, each of said strap ends is connected to opposing side edge surfaces of said transversely flared front portion to permit said strap to wrap around an arch or ball portion of a user's foot.

10. A leg exercise device as in claim 9 wherein:

(a) said front half portion includes at least one buckle enclosure for rapid and efficient tensioning of said strap so that the length of said strap need only be adjusted one time for repeated use by the same user; and (b) said buckle enclosure is disposed adjacent said hook member and is held in its closed position by an overlapping portion of said weight-receiving hook member when said weight clip is mounted onto said hook member.

11. A leg exercise device as in claim 7 wherein:

(a) said locking means includes a cam and lever arrangement for actuating a spring-biased retaining pin, said lever is disposed along at least one of said sides of said weight clip elongated body for convenient actuation by a user;

(b) said ankle hook member has a pin-receiving bore hole for receivingly retaining said spring-biased retaining pin when said weight clip is mounted onto said hook member and said lever is actuated by said user.

12.. A leg exercise device as in claim 11 wherein;

(a) said front collar half portion includes a laterally extending and transversely flared portion disposed to cover a top surface of a user's foot; and (b) said securing means is an adjustable strap having a pair of ends, each of said strap ends is connected to opposing side edge surfaces of said transversely flared front portion to permit said strap to wrap around an arch or ball portion of a user's foot.

13. A leg exercise device as in claim 12 wherein:

(a) said strap includes a buckle enclosure at one end to permit single buckle closure adjustability; and (b) said buckle enclosure is disposed adjacent said ankle hook member and is held in its closed position by an overlapping portion of said weight-receiving hook member when said weight clip is mounted onto said hook member.

14. A leg exercise device as in claim 7 which includes:

(a) a pair of ankle boots comprising a right-leg ankle boot and a left-leg ankle boot each having an associated weight clip; and (b) each of said weight clips is sufficiently dimensioned and configured to permit the compact interconnection thereof with another of a pair of identical weight clips, when said pair of weight clips is oriented faced together and with a first one of said pair of weight clips inverted with respect to a second one of said pair of weight clips, whereby a handle of each of said weight clips is receivingly engaged by said weight-receiving hook member and spring-biased weight release member of the other weight clip, so that said left and right-leg ankle boots may be attached to either back facing portion of either of said weight clips to permit transport of said pair of ankle boots and weight clips as a single interconnected unit.

15. A combination package and leg exercise device comprising in operative combination:

(a) a pair of ankle boots for a left and right ankle of a user, each ankle boot having a hook member medially disposed on a forward facing outer surface;

(b) a pair of identical weight clips, each weight clip having a handle and weight-receiving hook member and spring-biased weight release member which permits a user to pick up and retain a dumbbell-type weight within said weight-receiving hook member and attach said weight clip and dumbbell-type weight to either of said ankle boot hook members;

(c) said weight clips being dimensioned and configured to permit compact interconnection to each other when oriented faced together and with a first one of said weight clips inverted with respect to a second one of said weight clips whereby the handle of each of said weight clips is receivingly engaged by the weight receiving hook member and spring-biased weight release member of the other weight clip so that said left and right-legged ankle boots may be attached to a back facing portion of either of said weight clips to permit transport of said pair of ankle boots and weight clips as a single interconnected unit; and (d) a container having a padded inner surface having a cavity configured to support said single interconnected unit when placed in said package container.

* * * * *